United States Patent [19]

Keys

[11] Patent Number: 4,622,241

[45] Date of Patent: Nov. 11, 1986

[54] METHOD AND APPARATUS FOR ACCURATELY DISPENSING A SOLUTION

[75] Inventor: Steven F. Keys, Churubusco, Ind.

[73] Assignee: Essex Group, Inc., Fort Wayne, Ind.

[21] Appl. No.: 765,733

[22] Filed: Aug. 13, 1985

Related U.S. Application Data

[63] Continuation of Ser. No. 602,252, Apr. 20, 1984, abandoned.

[51] Int. Cl.[4] ..... B05C 1/06; B05D 1/28

[52] U.S. Cl. ..... 427/117; 118/694; 118/234; 118/267; 427/429

[58] Field of Search ..... 118/684, 693, 694, 268, 118/234, 264, 267; 427/117, 434.2, 434.7, 429

[56] References Cited

U.S. PATENT DOCUMENTS

| | | | |
|---|---|---|---|
| 3,329,123 | 7/1967 | Mohn et al. | 118/684 |
| 3,420,263 | 1/1969 | Ohlsson | 137/392 |
| 3,955,358 | 5/1976 | Martz et al. | 60/39.182 |
| 4,042,724 | 8/1977 | Nowracaj | 427/9 |
| 4,384,184 | 5/1983 | Alvarez | 200/84 C |

*Primary Examiner*—John P. McIntosh

*Attorney, Agent, or Firm*—Robert P. Hayter

[57] ABSTRACT

Apparatus and a method for dispensing a solution for use in a process including a flow meter and a precision valve are disclosed. A solenoid valve is incorporated within the dispensing apparatus and is electrically connected to the process for preventing flow during process interruption periods. Additional alarm means and safety interlocks are provided for controlling flow based upon operating conditions of the process.

10 Claims, 5 Drawing Figures

METHOD AND APPARATUS FOR ACCURATELY DISPENSING A SOLUTION

This application is a continuation of Ser. No. 602,252, filed Apr. 20, 1984, now abandoned.

BACKGROUND OF THE INVENTION

This invention relates to a method and apparatus for regulating the volume flow rate of a fluid including a solution. More specifically the invention concerns providing apparatus for accurately measuring and controlling the rate of flow of a solution and providing solution flow control in response to process operation and overflow or underflow conditions.

In the production of magnet wire an insulation layer is often applied to the exterior of the magnet wire such that the wire may subsequently be wound into its end use configuration having adjacent turns and layers in which the insulation layer providing electrical insulation between adjacent turns and layers. In order to provide such a wire it has been common to provide a coating having insulating properties which is applied to the exterior of the wire.

Additionally since the magnet wire is wound into a tightly wrapped configuration such as an electric motor stator or a solenoid or other coil, the wire needs a lubricant on its exterior surface to promote handling of the wire while reducing the potential for wire breakage. The applicator described herein is capable of both applying a lubricant solution to a moving wire as well as applying an insulating coating thereto.

One method of applying either a lubricant or an insulating enamel to magnet wire is to have a moving wire pass through a felt applicator. Lubricant or enamel is wicked upwardly from a reservoir of solution to the felt immediately adjacent the wire and transferred from the felt to the wire to apply the coating. The amount of solution supplied by the felt to the wire is based on the wicking ability of the felt and the distance between the solution and the wire through which the solution must be wicked. The height of the reservoir of solution in contact with the felt applicator determines the distance between the reservoir of solution and the wire to be coated. The distance therebetween controls the amount of solution being applied to the wire. Variants in the height level of the solution affects the thickness of the coating applied.

Prior art systems have attempted to regulate the amount of solution supplied to the reservoir using an automotive type carburetor. A reduced diameter orifice is fed and controlled by a float valve within the carburetor. It has been found however that the oscillation and flow from the carburetor based upon a control from the float valve is such that the height of the reservoir rises and falls creating a variance in the amount of solution applied to the exterior surface of the wire.

Another method of regulating the height of the reservoir is to utilize a float valve mounted in the reservoir to travel upwardly and downwardly as the height of the reservoir rises and falls. It has been found that such a valve lacks the sensitivity needed to accurately control the desired height of the reservoir.

The herein apparatus utilizes a highly sensitive flow meter and a precision valve such that the rate of flow of solution may be controlled very accurately. In this manner the rate of flow of solution to the reservoir is controlled to thereby control the rate of application of the solution from the reservoir to the wire. In addition a solenoid valve is provided such that flow to the reservoir is interrupted if the wire manufacturing process is stopped. In this manner no excess solution is supplied to the tank during those intervals when the wire is not being drawn through the applicator. Additionally, a float valve is provided as a safety means for indicating either high or low levels in the reservoir. This float valve may be utilized to deenergize the solenoid preventing further solution flow to the reservoir if a high level of solution in the reservoir is detected and to energize an alarm of a low level of solution in the reservoir is detected.

SUMMARY OF THE INVENTION

It is an object of the present invention to provide apparatus for regulating the flow of solution to an applicator.

It is a further object of the present invention to provide apparatus and a method for precisely regulating solution flow to an application process.

It is still further object of the present invention to provide a method of controlling solution flow to an applicator dependent upon the energization of a process involving the application of the solution to a moving surface.

It is another object of the present invention to provide safety means for interrupting the flow of solution to the applicator upon high liquid level conditions being detected.

It is a yet further object of the present invention to provide an alarm indication upon a lack of solution in the reservoir being detected indicating a potentially defective product being manufactured.

It is a further object of the present invention to provide a safe, economical, reliable, easy to operate apparatus and method of controlling the flow and application of the solution to a moving surface and for indicating alarm conditions.

Other objects will be apparent from the description to follow and the appended claims.

The above objects are achieved according to the preferred embodiment of the present invention by the provision of apparatus for regulating solution being dispensed to a process use which includes supply means for supplying solution, a flow meter for indicating the rate of solution flow through the meter, a valve for adjusting the volume flow rate of solution and for discharging the solution to the process use. Conduit means are provided to serially connect the supply means, the flow meter and the valve in a solution circuit such that the valve regulates the flow rate of solution which may be modulated based on the flow rate indicated by the flow meter. A solenoid valve positioned in the conduit means acts to prevent the flow of solution therethrough, said valve acting to allow solution to flow only when the process use is consuming solution.

A method of controlling the amount of solution supplied to an applicator which defines a reservoir for supplying the solution to coat a moving workpiece is further disclosed. The method includes the steps of supplying solution from a source of solution to said reservoir, adjusting the flow rate of solution based on the flow rate indicated by a flow rate meter, and preventing solution flow to said reservoir when the workpiece is not moving.

DESCRIPTION OF THE PREFERRED EMBODIMENT

The herein invention will be described in reference to the embodiment shown in the attached drawings. It is to be understood that this invention has applicability to other similar applications wherein a liquid is coated on a moving surface. Additionally it is to be understood that the specific number of wires being simultaneously coated, the specific angles of the various slits and the relative locations therebetween are matters of choice for a particular application.

Figure 1:
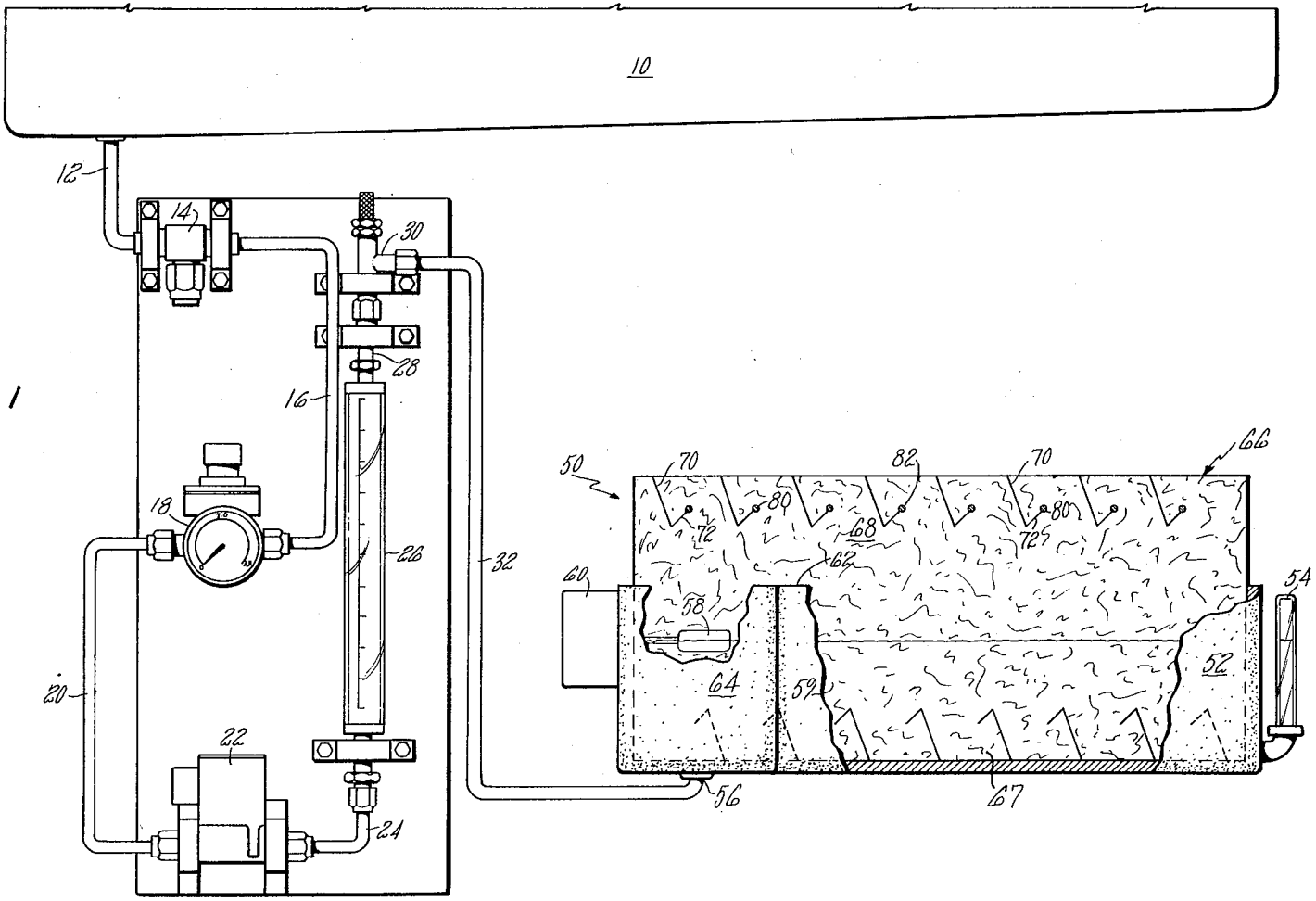
FIG. 1 is a schematic view of a dry lubricant solution application system.

Referring now to FIG. 1 it may be seen that tank 10 contains a quantity of a dry lubricant solution referred to as reservoir 59. This solution typically includes, a small amount of paraffin wax and/or bee's wax in a heptane solvent. When applied to the wire the solvent evaporates leaving the wax on the exterior surface of the wire as a dry lubricant.

Conduit 12 conducts lubricant solution from tank 10 to filter 14. Conduit 16 conducts the lubricant from filter 14 through pressure gauge 18 to conduit 20 to solenoid valve 22. From solenoid valve 22 lubricant flows through conduit 24 to flow meter 26 and from there through conduit 28, through valve 30, and through conduit 32 to tank 52. Filter 14 is used to screen all unwanted particles from the lubricant solution. Pressure regulator and gauge 18 is utilized to regulate and determine the pressure of the fluid being supplied thereto. If the filter becomes dirty or the tank becomes empty the pressure will drop and the operator, by observing the pressure indicated by the gauge, will determine that action needs to be taken. Solenoid valve 22 is provided to selectively prevent further lubricant solution from flowing to tank 52.

Flow meter 26 is used in combination with precision valve 30 to regulate the flow of lubricant solution to the tank. Since the volume of lubricant being applied to the wire is small, the flow meter is utilized in conjunction with the precision valve to regulate the flow to the tank in a precise manner. Additionally by regulating the flow to the tank the level within the tank is controlled to obtain the desired wicking effect to obtain the desired coating thickness on the wire. Should the level in the tank be allowed to rise then the amount of wicking increases dramatically and the amount of coating on the wire increases. Again should the level drop below a desired level, then the opposite happens and the amount of lubricant placed on the exterior surface of the wire is significantly reduced. Hence, it is significant that the valve appropriately control the desired flow rate as indicated by the flow meter to provide a coating level on the wire which is optimal.

Tank 52 defines a reservoir of solution as indicated. Level gauge 54 is mounted at one end of the tank and provides a visual indication of the level of the solution in the tank. Float 58 connected to float gauge 60 is additionally placed in float pocket 64 of the tank, and, as will be later explained, has various electrical connections for indicating certain operating conditions. A proximity switch based on photoelectric, inductive or capacitive sensing could also be used. Lubricant applicator 50 is indicated generically to be the entire assembly of tank 52 containing felt applicator 66. Felt applicator 66 is a rectangular planar felt member extending in an upright position which may be vertical or inclined within the tank such that a bottom or absorption portion 67 of the felt is immersed within the solution and a top or application portion 68 of felt extends above the solution. Additionally application portion 68 at least partially extends above side wall 62 of the tank such that wires 80 may extend through the applicator without engaging the tank per se.

The felt applicator defines an entry slit 70 extending from the top of the applicator downwardly at an acute angle to vertical. From the bottom of entry slit 70, an angle slit 72 extends upwardly a short distance terminating at coating position 82 wherein wire 80 is secured. This coating position is located a distance below the top of the felt applicator such that the wire is secured therein. Upon an easing of tension in the wire, the wire is maintained in the coating position due to the geometry of the entry and angle slits and due to the deformation of the applicator by the continuous operation of the wire therethrough. In the particular applicator shown there are eight sets of entry and angle slits designed to act with eight wires being simultaneously lubricated. This applicator is designed such that numerous other application configurations could be used such as more slits or using only half the slits at a time such that on a regular basis the wires could be operated through other slits. Additionally absorption portion 67 of the applicator may be provided with symmetrical slits such that the applicator may be removed from applicator holder 64, inverted and reinserted with the slits which were previously immersed in solution now being the slits at the top of the applicator such that wire may be inserted therein in the same manner as the slits previously described.

Figure 2:
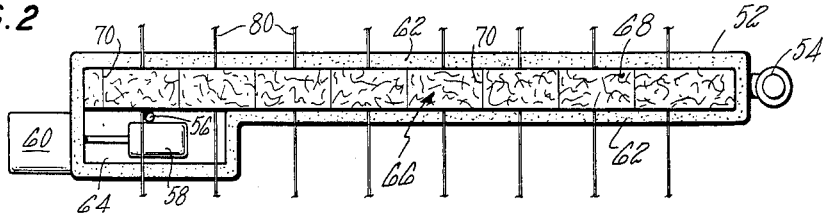
FIG. 2 is a top view of the lubrication applicator of FIG. 1.

FIG. 2 is a top view of tank 52 of FIG. 1. Therein it may be seen that tank 52 defines side walls 62. Float 58 of float valve 60 is shown within float pocket 64 as is connection 56 for conduit 32 to supply solution to the tank. Wires 80 are shown traversing the tank and being located within the applicator displaced a distance from that portion where entry slit 70 terminates at the surface of the felt applicator.

Figure 3:
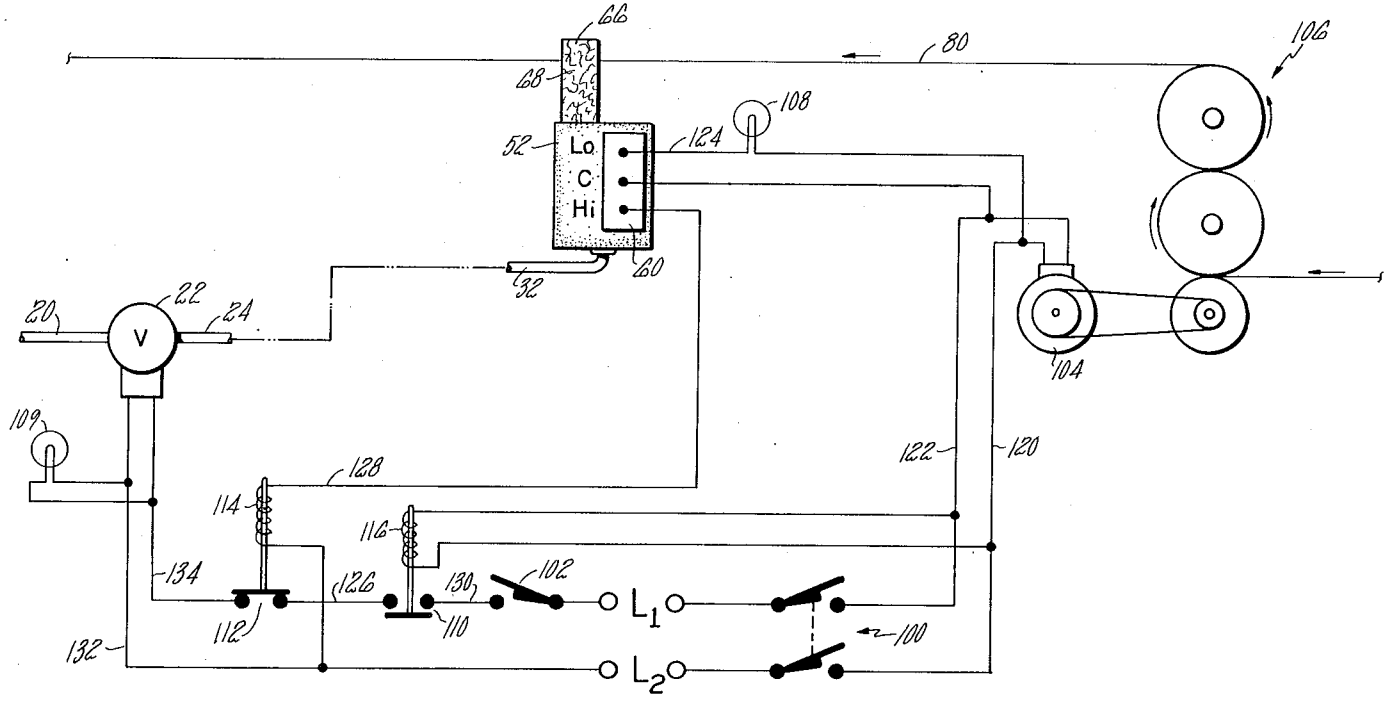
FIG. 3 is a schematic diagram showing a circuit for controlling operation of the lubricant application system.

FIG. 3 is a schematic drawing detailing the manner of operation of a liquid application system. In the schematic it may be seen that wire 80 passes through felt applicator 66 held by holder 64 and is secured in capstan assembly 106. The capstan assembly acts to regulate the speed of the wire passing through the applicator. Capstan assembly 106 is powered by capstan motor 104.

Float 58 mounted within tank 52 senses the level of the solution in the tank and acts to make electrical connections at float gauge 60. These connections are labeled low, C for common, and high such that upon a low level of fluid being detected the low connection is energized, and upon a high level of fluid being detected the high connection is energized.

Solenoid valve 22 regulating the flow of lubricant into the tank is also shown.

Power is supplied from lines L1 and L2 through capstan switch 100 and through wires 120 and 122 to the capstan motor. Additionally wire 120 connects the capstan switch to coil 116 for operating capstan relay contacts 110 and to low solution indicator 108. Wire 124 connects the low level connection of float gauge 60 to low solution indicator 108. Wire 128 connects the high level position of float gauge 60 to coil 114 for operating high solution relay contacts 112.

Solenoid switch 102 acts to connect line L1 through wire 130, through capstan relay contacts 110 if in the closed position, through wire 126, through high solution relay contacts 112 if in the closed position and through wire 134 to solenoid 22 and to solenoid open indicator 109. wire 132 connects line L2 to coil 114, to solenoid open indicator 109 and to solenoid valve 22.

To operate the production line producing wire, capstan switch 100 is closed energizing capstan motor 104 from lines L1 and L2. At the same time power is supplied to the float gauge 60. Float gauge 60 does not act to energize either the low level or high level contacts unless the float detects a solution level beyond the normal range. Once capstan switch 100 is closed, power is additionally supplied through lines 122 and 120 to coil 116 which acts to close the capstan relay contacts 110 to allow the solenoid valve 22 to be opened. Absent capstan switch 100 being in a closed position, the solenoid valve may not be operated to allow solution to flow to the tank. Hence, upon the production line being shut down by deenergizing the capstan switch, the solenoid valve closes thereby preventing further solution flow to the tank.

Should float gauge 60 detect a low solution condition, then low solution indicator 108 is energized through wire 124 to indicate to the operator that insufficient solution is being supplied to the tank.

Should float gauge 60 energize the high level solution indicator, then coil 114 is energized to break the circuit to solenoid valve 22 to prevent further solution from being supplied to the tank. The solenoid valve is deenergized to prevent further solution being supplied since this solution may be highly flammable and spillage conditions are highly undesirable. Additionally by limiting the level to which the solution may rise the coating of excessive amounts of lubricant on the wires is prevented.

Solenoid open indicator 109 is a visual indicator (may also be an audible alarm) designed to be energized when the solenoid valve is energized allowing lubricant flow therethrough. This light is energized whenever the solenoid switch is closed, the capstan switch is closed closing capstan relay contacts 110 and the high level indicator from the float gauge has not been energized. In this mode the solenoid valve is open and the solenoid open indicator is energized. Should either the solenoid switch or the capstan switch be opened, or the float gauge detect a high level, then the solenoid valve will be deenergized and the solenoid open indicator will not be energized.

Figure 4:
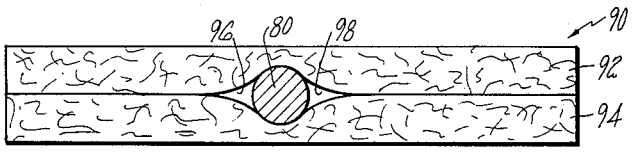
FIG. 4 PRIOR ART
FIG. 4 is a sectional view of a prior art applicator.

FIG. 4 is a sectional view of felt sandwich as known in the prior art. The wire was placed between two layers of felt, one of which was immersed in a liquid solution. The felt would act to wick the liquid solution upwardly and apply same to the wire. The felt would additionally act to wick a portion of the solution from one piece of felt to the other to provide lubricant to both sides of the wire. However as may be seen between upper half 92 and lower half 94 of the felt sandwich 90, there is defined a left dead space 96 and a right dead space 98. Between these dead spaces it is apparent that a significant portion of the wire surface is not in contact with the felt and hence does not have lubricant applied directly thereto. Additionally the interface between the two separate felt portions affects the amount of lubricant being wicked therebetween.

Figure 5:
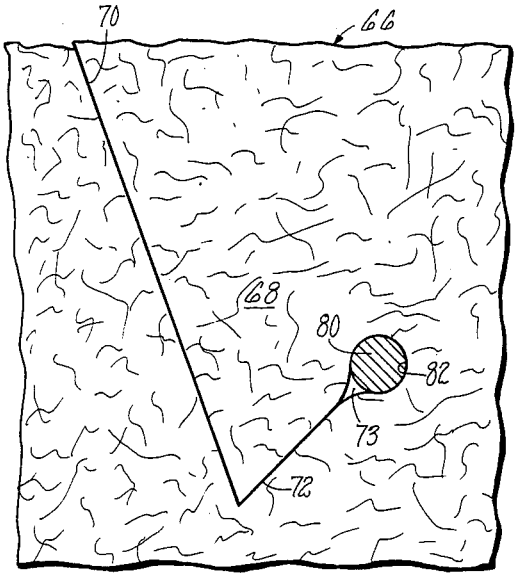
FIG. 5 is a sectional view of the present felt applicator.

FIG. 5 is a sectional view of the herein felt applicator. It may be seen that wire 80 is secured within coating position 82 at the end of angle slit 72. In this position the only dead space is dead space 73 formed within angle slit 72 just prior to wire 80. Entry slit 70 and angle slit 72 are essentially closed except for the dead space immediately adjacent the wire. Since the felt applicator is but a single piece the solution may be wicked entirely around the wire without having to cross an interface between distinct felt portions. In this manner the lubricant may be more evenly applied about the entire surface of the wire to effect a more uniform coating.

The invention has been described with reference to a particular embodiment. It is to be understood by those skilled in the art that variations and modifications can be effected within the spirit and scope of the invention.

I claim:

1. Apparatus for regulating the flow of solution being dispensed to a tank having a wicking applicator at least partially immersed in a reservoir of solution contained in the tank for coating a moving wire with the solution, the thickness of said solution on the wire being dependent on the distance between the level of the reservoir of solution in the tank and the location where the wire contacts the applicator, which comprises:

supply means for supplying solution;

a flow meter for accurately indicating the rate of solution flow through the meter;

a valve for adjusting the volume flow rate of solution and for discharging the solution to the reservoir;

conduit means serially connecting the supply means, the flow meter and the valve in a solution circuit such that the valve regulates the flow rate of solution and may be modulated based on the flow rate indicated by the flow meter; and a solenoid valve positioned in the conduit means to prevent the flow of solution therethrough, said valve acting to allow solution to flow to the reservoir only when the moving wire is consuming solution from the reservoir through the wicking applicator such that the distance between the level of the reservoir and the location where the wire contacts the applicator is maintained whereby the solution is coated on the wire with a uniform thickness.

2. The apparatus as set forth in claim 1 including applying the solution to coat a moving wire and wherein the valve discharges the solution to a tank defining a reservoir of solution of a desired height and further comprising:

level detection means positioned to sense the level of solution in said reservoir, said level detection means being electrically connected to close the solenoid valve to prevent further solution flow to the tank upon a high level of solution being detected.

3. The apparatus as set forth in claim 2 wherein the level detection means further includes means for generating an electric signal upon a low level of solution being detected and further comprising an alarm means connected to the level detection means to be energized in response to said electric signal.

4. The apparatus as set forth in claim 1 wherein the supply means is a tank of solution mounted vertically above the applicator such that solution flows therebetween and further comprising:

filter means and pressure regulator and indicator means serially connected by the conduit means between the supply means and the solenoid valve, said filter means acting to remove unwanted particulates from the solution and said pressure regulator and indicator means indicating by a drop from the operating pressure level either a clogged filter or insufficient solution being supplied.

5. A method of controlling the rate at which solution is supplied to a reservoir within a tank having a wicking applicator immersed in the tank, said applicator defining slits through which a wire travels and is coated with solution wicked by the applicator from the reservoir to the wire, the thickness of the solution coated on the wire being dependent on the distance between the reservoir and the location where the applicator engages the wire which comprises the steps of:

supplying solution from a source of solution to said reservoir;

adjusting the flow rate of solution based on the flow rate indicated by a flow rate meter to maintain the distance between the reservoir and the location where the applicator engages the wire constant; and preventing solution flow to said reservoir when the wire is not moving to maintain the distance between the reservoir and the location where the applicator engages the wire constant whereby the solution is coated on the wire with uniform thickness.

6. The method as set forth in claim 5 and further comprising the steps of:

monitoring the level of the solution in the reservoir; and preventing solution flow to said reservoir when the level monitored exceeds a predetermined level.

7. The method as set forth in claim 6 and further comprising:

energizing an alarm if the step of monitoring detects the level of the reservoir is below a preselected level.

8. The method as set forth in claim 7 and further comprising the step of:

energizing an indicator to indicate the step of preventing the solution from flowing is not being utilized.

9. The method as set forth in claim 8 and further comprising the steps of:

filtering unwanted particulates from the solution; and indicating a pressure in the supply of solution to indicate either a clogged filter or insufficient supply of solution.

10. The method as set forth in claim 5 wherein an electric motor driven capstan is used to move the wire and wherein the step of preventing solution flow further comprises:

preventing solution flow to the reservoir when the electric motor driving the capstan is not energized.

* * * * *